US011034501B2

(12) United States Patent
Fielder

(10) Patent No.: US 11,034,501 B2
(45) Date of Patent: Jun. 15, 2021

(54) PACKAGING SYSTEM AND METHOD

(71) Applicant: Packaging Concepts & Design, LLC, Troy, MI (US)

(72) Inventor: Terry L. Fielder, Westland, MI (US)

(73) Assignee: Packaging Concepts & Design, LLC, Troy, MI (US)

( * ) Notice: Subject to any disclaimer, the term of this patent is extended or adjusted under 35 U.S.C. 154(b) by 13 days.

(21) Appl. No.: 16/249,321

(22) Filed: Jan. 16, 2019

(65) Prior Publication Data

US 2019/0218012 A1 Jul. 18, 2019

Related U.S. Application Data

(60) Provisional application No. 62/618,252, filed on Jan. 17, 2018.

(51) Int. Cl.
*B65D 85/68* (2006.01)
*B65D 81/05* (2006.01)

(52) U.S. Cl.
CPC ..... *B65D 81/055* (2013.01); *B65D 81/053* (2013.01); *B65D 85/68* (2013.01); *B65D 2585/6882* (2013.01)

(58) Field of Classification Search
CPC .... B65D 81/053; B65D 81/055; B65D 85/68; B65D 2585/6882
USPC ..... 206/335, 453, 486, 487, 586, 591, 592, 206/594, 521, 523, 454, 710
See application file for complete search history.

(56) References Cited

U.S. PATENT DOCUMENTS 3,356,209 A * 12/1967 Pezely, Jr. ..... B65D 81/107 206/523
4,261,466 A * 4/1981 Wilford ..... B65D 73/0042 206/335
5,522,539 A * 6/1996 Bazany ..... B65D 5/5088 206/523
5,755,331 A * 5/1998 Watson ..... B65D 81/05 206/320
6,092,654 A * 7/2000 Webb ..... B65D 5/5045 206/319

(Continued)

FOREIGN PATENT DOCUMENTS

JP 3059189 B2 7/2000
JP 5429420 B2 2/2014

(Continued)

OTHER PUBLICATIONS

International Search Report and Written Opinion for the related PCT application PCT/US2019/013801 dated May 8, 2019.

(Continued)

*Primary Examiner* — Luan K Bui
(74) *Attorney, Agent, or Firm* — Honigman LLP

(57) ABSTRACT

A packaging system included a support member and a packing component. The support member includes a base, a head portion, and a leg. The head portion extends from the base in a first direction. The leg extends from the base in a second direction opposite the first direction. The packing component includes a first portion and a second portion. The first portion defines a first aperture configured to receive the leg. The second portion defines a second aperture configured to receive the head portion.

11 Claims, 3 Drawing Sheets

(56) References Cited

U.S. PATENT DOCUMENTS

| | | | | |
|---|---|---|---|---|
| 6,644,476 | B2 * | 11/2003 | Wu | B65D 81/05 206/586 |
| 6,666,334 | B2 | 12/2003 | Fujii | |
| 6,688,649 | B2 * | 2/2004 | Casagrande | G09F 3/0288 206/449 |
| 2006/0289331 | A1 * | 12/2006 | Brittain | B65D 5/5054 206/586 |
| 2007/0029223 | A1 * | 2/2007 | Mazurek | B65D 73/0092 206/463 |

FOREIGN PATENT DOCUMENTS

| | | | |
|---|---|---|---|
| JP | 2017001715 | A | 1/2017 |
| KR | 19980033789 | U | 9/1998 |

OTHER PUBLICATIONS

International Preliminary Report on Patentability dated Jul. 30, 2020, relating to International Application No. PCT/US2019/013801.

* cited by examiner

PACKAGING SYSTEM AND METHOD

CROSS REFERENCE TO RELATED APPLICATIONS

This U.S. patent application claims priority under 35 U.S.C. § 119(e) to U.S. Provisional Application 62/618,252, filed on Jan. 17, 2018. The disclosure of this prior application is considered part of the disclosure of this application and is hereby incorporated by reference in its entirety.

FIELD

The present disclosure relates to a packaging system and method, and more particularly to a multi-component packaging system and a related method of assembling a multi-component packaging system.

BACKGROUND

This section provides background information related to the present disclosure and is not necessarily prior art.

Packaging systems are used to secure and transport various types of parts and assemblies, such as automotive parts and assemblies, for example. Packaging systems often include one or more inner packing components (e.g., support members, trays, etc.) and an outer container (e.g., boxes). For example, the packing component(s) may be placed around, and in engagement with, the part or assembly, while the packing component(s), together with the part or assembly, may be placed within the outer container. In some instances, more than one outer container may be placed within or on a shipping instrument (e.g., a pallet, a shipping container, a box, etc.) prior to transporting the packaging system and the parts or assemblies.

While known packaging systems and known packing components have proven useful for their intended purpose, a need for continuous improvement remains in the pertinent art.

SUMMARY

This section provides a general summary of the disclosure, and is not a comprehensive disclosure of its full scope or all of its features.

One aspect of the disclosure provides a packaging system. The packaging system may include a support member and a packing component. The support member may include a base, a head portion, and a leg. The head portion may extend from the base in a first direction. The leg may extend from the base in a second direction opposite the first direction. The packing component may include a first portion and a second portion. The first portion may define a first aperture configured to receive the leg. The second portion may define a second aperture configured to receive the head portion.

Implementations of the disclosure may include one or more of the following optional features. In some implementations, the packing component includes an upper surface engaging the base.

In some implementations, the packing component includes a first upper surface and a second upper surface, and the base includes an upper surface and a lower surface. The first upper surface may be configured to engage the upper surface of the base. The second upper surface may be configured to engage the lower surface of the base. The first upper surface may be coplanar with the second upper surface. In some implementations, the packing component defines an axis extending along the first upper surface and the second upper surface. The packing component may also define one or more perforations disposed along the axis. The second aperture may be defined in part by an edge extending along the axis.

In some implementations, (i) the leg is disposed within the first aperture, (ii) the head portion is disposed within the second aperture, (iii) the first portion of the packing component faces a first side of the base, and (iv) the second portion of the packing component faces a second side of the base. The second side may be opposite the first side. The packing component may define a fold extending between the first portion and the second portion.

Another aspect of the disclosure provides a packaging system. The packaging system may include a support member and a packing component. The support member may include a base, a head portion, and a leg. The head portion may extend from the base in a first direction. The leg may extend from the base in a second direction opposite the first direction. The packing component may define a first aperture and a second aperture. The leg may be disposed within the first aperture. The head portion may be disposed within the second aperture.

This aspect may include one or more of the following optional features. In some implementations, the base includes an upper surface and a lower surface. The packing component may include an upper surface engaging the upper surface of the base and the lower surface of the base.

In some implementations, the second aperture is defined in part by an edge. The support member may include a primary leg extending from the base in the second direction. The primary leg may engage the edge.

A further aspect of the disclosure provides a method of assembling a packaging system. The packaging system may include a support member and a packing component. The support member may include a base, a head portion, and a leg. The packing component may include a first portion and a second portion. The first portion may include a first upper surface defining a first aperture. The second portion may include a second upper surface defining a second aperture. The method may include placing the leg within the first aperture. The method may also include placing the head portion within the second aperture. The method may further include engaging the base with the second upper surface.

This aspect may include one or more of the following optional features. In some implementations, the method includes engaging the base with the first upper surface.

In some implementations, the method includes folding the packing component along an axis extending between the first portion and the second portion.

In some implementations, the second aperture is defined in part by an edge, and the support member includes a primary leg. The method may further include engaging the primary leg with the edge. The method may also include folding the packing component along an axis extending between the first portion and the second portion. The axis may be parallel to the edge.

In some implementations, the method includes coupling the packing component to a container.

In some implementations, the packing component includes a lower surface opposite the first upper surface or the second upper surface. The method may further include coupling the lower surface to a container. Coupling the lower surface to the container may include adhering the lowering surface to the container.

The details of one or more implementations of the disclosure are set forth in the accompanying drawings and the description below. Other aspects, features, and advantages will be apparent from the description and drawings, and from the claims.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
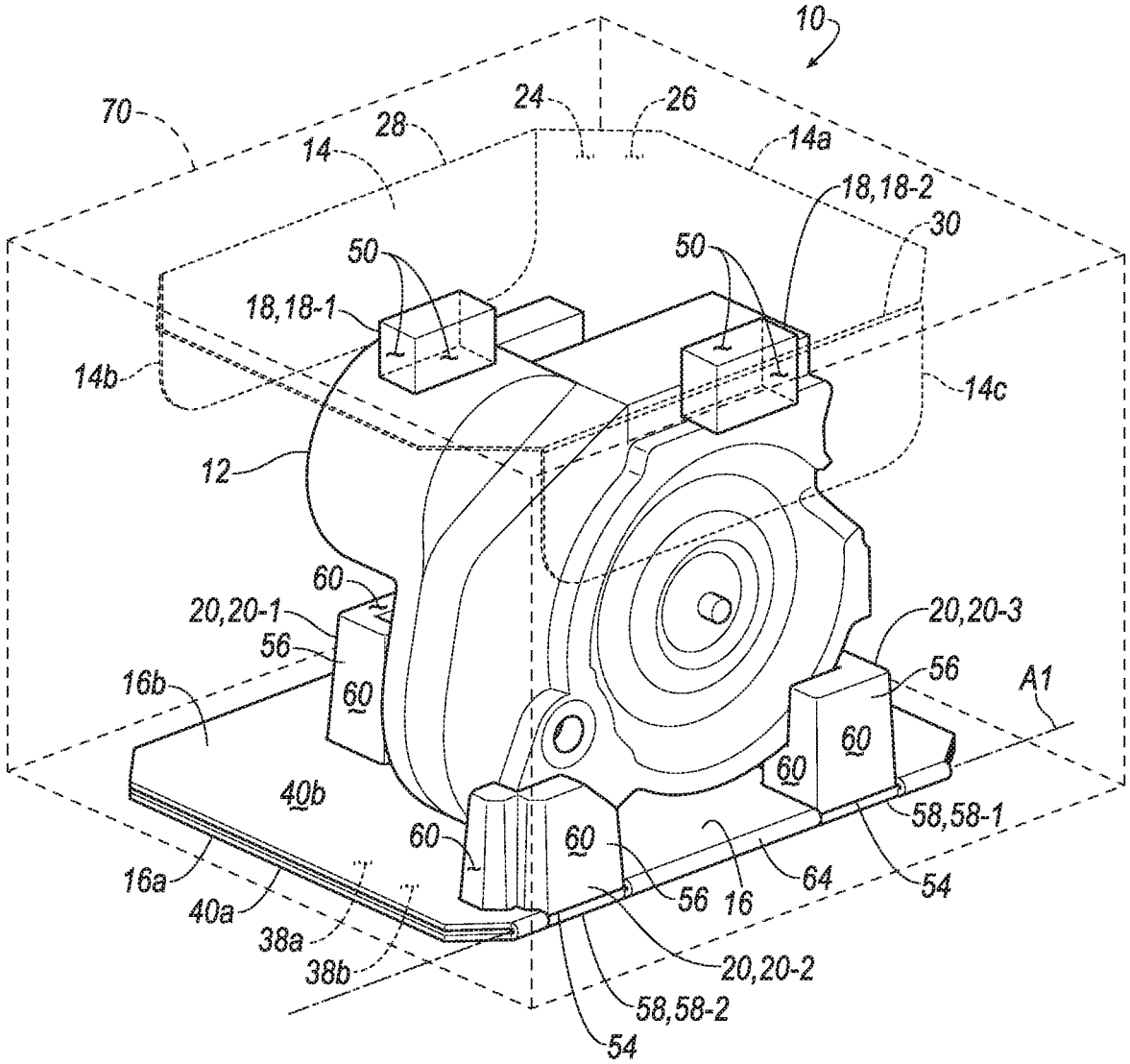
FIG. 1 is a perspective view of a packaging system and a packaged component in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

With reference to FIG. 1, a packaging system 10 for packaging and transporting a component is provided. In some implementations, the packaging system 10 may be utilized for packaging and transporting a component for an automobile or other motorized vehicle. In particular, in some implementations, the packaging system 10 may be utilized for packaging and transporting a transmission 12 of an automobile. It will be appreciated, however, that the packaging system 10 may be used for holding and/or transporting other items within the scope of the present disclosure.

The packaging system 10 may include an upper packing component 14 (e.g., a top), a lower packing component 16 (e.g., a base), one or more upper supports 18 (e.g., support member 18), and one or more lower supports 20 (e.g., support member 20). The upper packing component 14 and the lower packing component 16 may be made from a rigid or semi-rigid material, such as plastic, wood, fiberboard, cardboard, metal (e.g., steel) or other similar material. Similarly, the upper supports 18 and the lower supports 20 may be made from a rigid or semi-rigid material, such as plastic, wood, fiberboard, cardboard, metal (e.g., steel) or other similar material. In some implementations, the upper packing component 14, the lower packing component 16, and the upper supports 18 are each made from a cardboard material, while the lower supports 20 are made from a plastic material (e.g., injection molded polymer).

The upper packing component 14 may include a central portion 14*a*, a first lateral portion 14*b*, and a second lateral portion 14*c*. In some implementations, the central portion 14*a*, the first lateral portion 14*b*, and the second lateral portion 14*c* are integrally or monolithically formed. The central portion 14*a* may include an upper surface 24 and a lower surface 26 opposite the upper surface 24. The upper and lower surfaces 24, 26 may extend from a first lateral edge 28 to a second lateral edge 30 opposite the first lateral edge 28. In some implementations, the upper or lower surfaces 24, 26 define a planar construct extending between the first lateral edge 28 and the second lateral edge 30. For example, in some implementations, the upper and lower surfaces 24, 26 define a planar construct extending from the first lateral edge 28 to the second lateral edge 30.

The first and second lateral portions 14*b*, 14*c* may extend from the central portion 14*a*. For example, the first lateral portion 14*b* may extend from the first lateral edge 28, and the second lateral portion 14*c* may extend from the second lateral edge 30. In some implementations, the first or second lateral portions 14*b*, 14*c* extend transversely to the upper or lower surfaces 24, 26 of the central portion 14*a*. For example, the first or second lateral portions 14*b*, 14*c* may extend orthogonally to the lower surface 26, such that the first lateral portion 14*b* is substantially parallel to (e.g., +/−10 degrees) the second lateral portion 14*c*.

Figure 2:
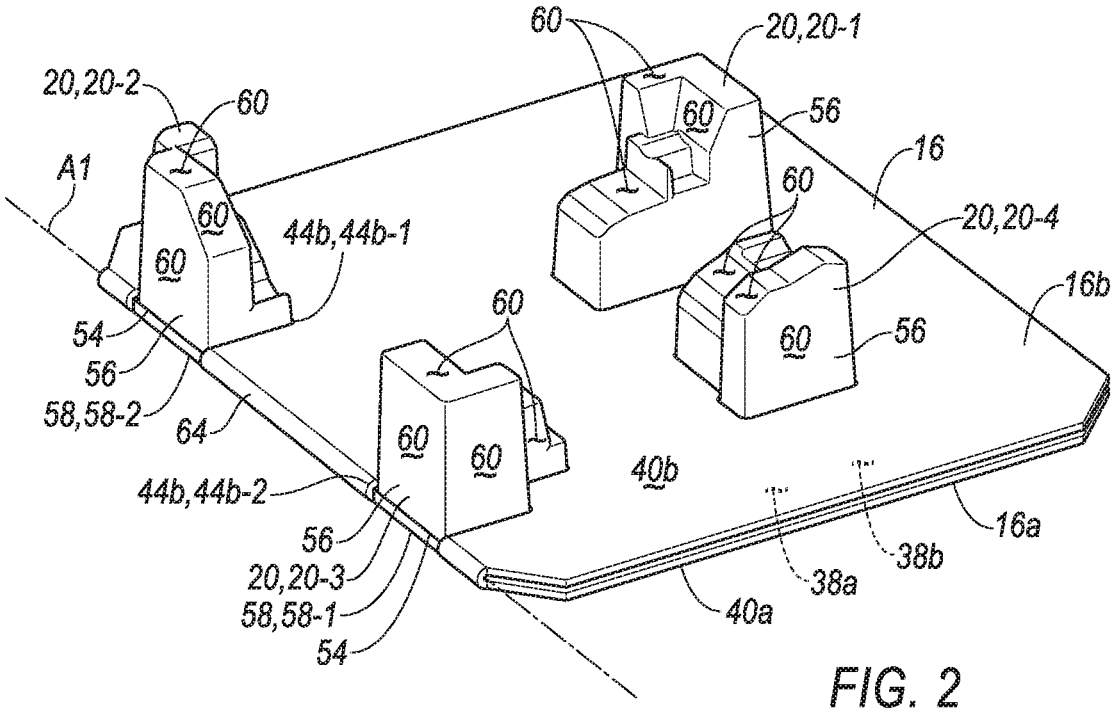
FIG. 2 is a top perspective view of a portion of the packaging system of FIG. 1.

The lower packing component 16 may include a first portion 16*a* and a second portion 16*b*. In some implementations, the first portion 16*a* is integrally or monolithically formed with the second portion 16*b*. In this regard, the first portion 16*a* may be delineated from the second portion 16*b* by a one or more perforations 34 or other similar features. In some implementations, the perforations 34 extend along an axis A1. As will be explained in more detail below, during assembly or use of the lower packing component 16, the perforations 34 may allow a user to more easily move (e.g., fold) the first portion 16*a* of the lower packing component 16 relative to the second portion 16*b* of the lower packing component 16, from a first orientation (FIG. 4) to a second orientation (FIG. 2).

Figure 4:
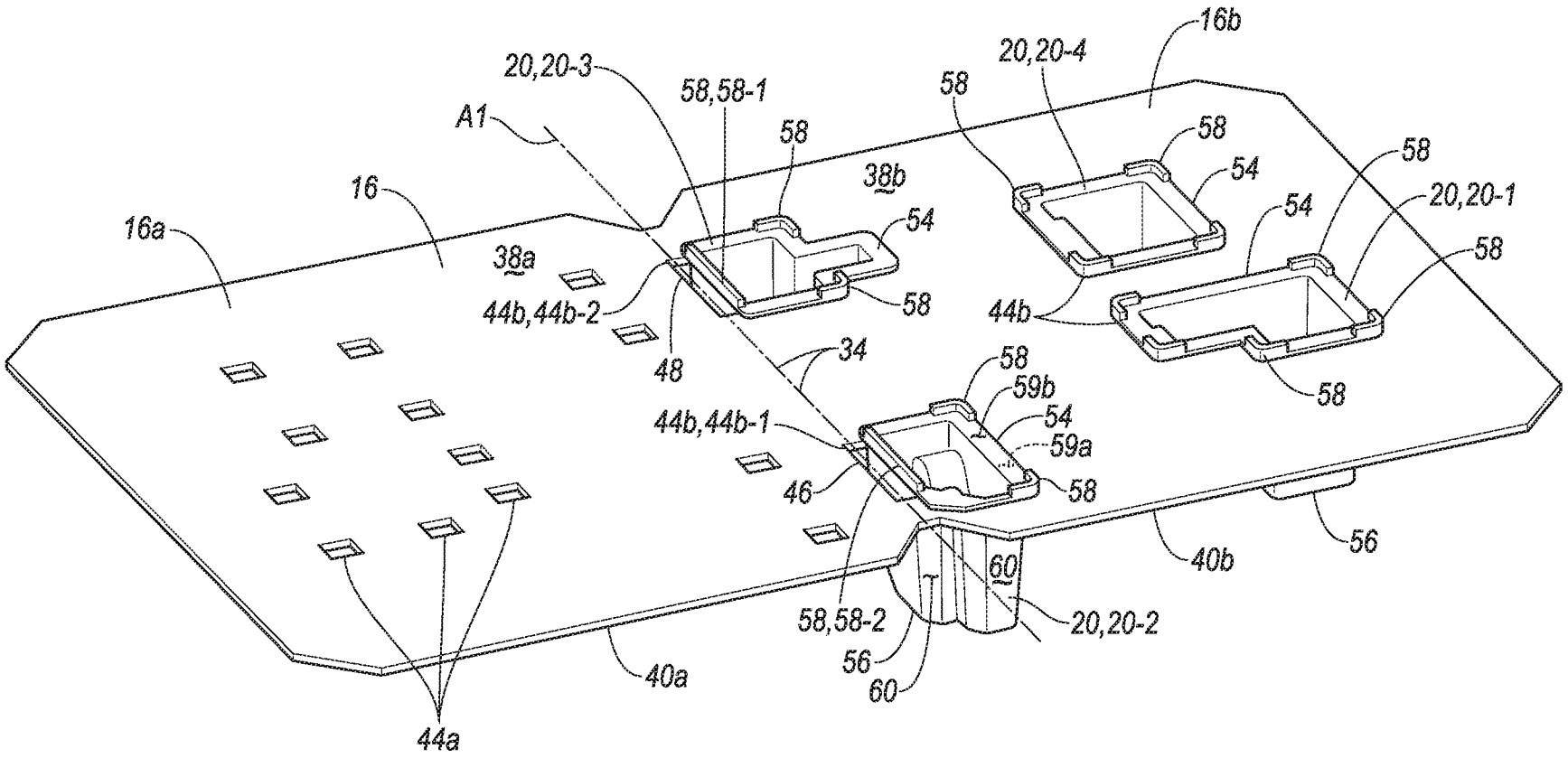
FIG. 4 is a top perspective view of a portion of the packaging system of FIG. 1, the portion shown in a second orientation.

The first and second portions 16*a*, 16*b* may each include an upper surface 38*a*, 38*b*, respectively, and a lower surface 40*a*, 40*b*, respectively, opposite the upper surface 38*a*, 38*b*. The upper surface 38*a*, 38*b* may define an inner side of the lower packing component, while the lower surface 40*a*, 40*b* may define an outer side of the lower packing component. As illustrated in FIG. 4, in the first orientation, the upper surface 38*a* may be parallel to, or coplanar with, the upper surface 38*b*, and the lower surface 40*a* may be parallel to, or coplanar with, the lower surface 40*b*. In this regard, the upper surface 38*a* and the lower surface 40*a* may be disposed on a first side of the axis A1, while the upper surface 38*b* and the lower surface 40*b* may be disposed on a second side of the axis A1 opposite the first side of the axis A1.

The upper and lower surfaces 24, 26 may extend from a first lateral edge 28 to a second lateral edge 30 opposite the first lateral edge 28. In some implementations, the upper or lower surfaces 24, 26 define a planar construct extending between the first lateral edge 28 and the second lateral edge 30. For example, in some implementations, the upper and lower surfaces 24, 26 define a planar construct extending from the first lateral edge 28 to the second lateral edge 30.

As illustrated in FIG. 4, the upper surface 38*a* of the first portion 16*a* may define one or more first apertures 44*a*, while the upper surface 38*b* of the second portion 16*b* may define one or more second apertures 44*b*. In some implementations, the first apertures 44*a* are defined by the upper and lower surfaces 38*a*, 40*a*, such that the first apertures 44*a* define one or more holes through the first portion 16*a* of the lower packing component 16. While the upper surface 38*a* is illustrated as defining thirteen generally rectangular first apertures 44*a*, it will be appreciated that the upper surface 38*a* may include more or less than thirteen first apertures 44*a* having various shapes within the scope of the present disclosure. In this regard, as will be explained in more detail below, the quantity, size, shape, or location of the first apertures 44*a* may correspond to the quantity, size, shape, or location of various features (e.g., legs) of the lower supports 20.

In some implementations, the second apertures 44*b* are defined by the upper and lower surfaces 38*b*, 40*b* of the second portion 16*b*, such that the second apertures 44*b* define one or more holes through the second portion 16*b* of the lower packing component 16. While the upper surface 38*b* is illustrated as defining four second apertures 44*b*, it will be appreciated that the upper surface 38*b* may include more or less than four second apertures 44*b* having various shapes within the scope of the present disclosure. In this regard, as will be explained in more detail below, the quantity, size, shape, or location of the second apertures 44*b* may correspond to the quantity, size, shape, or location of the lower supports 20.

A proximal aperture 44*b*-1 of the second apertures 44*b* may be defined in part by an edge 46, while a distal aperture 44*b*-2 of the second apertures 44*b* may be defined in part by an edge 48. The edge 46 and the edge 48 may extend along (e.g., parallel to or collinear with) the axis A1. In this regard, the edge 46 may be parallel to, or collinear with, the edge 48. In some implementations, the edge 46 or the edge 48 may be disposed on the first side of the axis A1, such that the axis A1 intersects the proximal aperture 44*b*-1 or the distal aperture 44*b*-2. In this regard, a portion of the proximal aperture 44*b*-1 and a portion of the distal aperture 44*b*-2 may be disposed on the first side of the axis A1, while the remaining portion of the proximal aperture 44*b*-1 and the distal aperture 44*b*-2 may be disposed on the second side of the axis A1.

With reference to FIG. 1, the upper supports 18 may include a first upper support 18-1 and a second upper support 18-2. In this regard, while the packaging system 10 is generally shown and described herein as including two upper supports 18, it will be appreciated that the packaging system 10 may include more or less than two supports 18 within the scope of the present disclosure.

Each of the upper supports 18 may include a plurality of surfaces 50 defining a three-dimensional construct. For example, the plurality of surfaces 50 may define a cuboid, a cylinder, a prism, or other three-dimensional shape. As will be described in more detail below, in the assembled configuration, one or more of the surfaces 50 of each support 18 may engage (i) the lower surface 26 of the central portion 14*a* of the upper packing component 14, (ii) the first lateral portion 14*b* of the upper packing component 14, or (iii) the second lateral portion 14*c* of the upper packing component 14. Another one or more of the surfaces 50 of each support 18 may engage the component (e.g., transmission 12) packaged or transported in the packaging system 10.

With reference to at least FIGS. 2 and 4, the lower supports 20 may include a first lower support 20-1, a second lower support 20-2, a third lower support 20-3, and a fourth lower support 20-4. In this regard, while the packaging system 10 is generally shown and described herein as including four lower supports 20, it will be appreciated that the packaging system 10 may include more or less than four lower supports 20 within the scope of the present disclosure. For example, quantity of lower supports 20 may correspond to the quantity of second apertures 44*b*

Each of the lower supports 20 may include a base 54, a head 56, and one or more legs 58. The base 54 may include an upper surface 59*a* and a lower surface 59*b* opposite the upper surface 59*a*. The head 56 may extend from the base 54 in a first direction and may include a plurality of surfaces 60 defining a three-dimensional construct. For example, the plurality of surfaces 60 may define a cuboid, a cylinder, a prism, or other three-dimensional shape. As will be described in more detail below, in the assembled configuration, one or more of the surfaces 60 of each support 18 may engage the component (e.g., transmission 12) packaged or transported in the packaging system 10. In this regard, one or more of the surfaces 60 may extend in a vertical direction, one or more of the surfaces 60 may extend in a horizontal direction (i.e., orthogonal to the vertical direction), and one or more of the surfaces may extend in a direction transverse to the horizontal or vertical directions, such that the head 56 defines one or more peaks or protruding portions and one or more valleys or recessed portions.

The legs 58 may extend from the base 54 in a second direction opposite the first direction. In this regard, the head 56 and the legs 58 may extend from the base 54 in opposite directions, while at least a portion of the base 54 may be disposed in, or otherwise define, a plane that is substantially orthogonal to (e.g., +/−15%) the first and second directions in which the head 56 and the legs 58 extend. The size (e.g., cross-sectional area) of the base 54 in, and relative to, the plane may be greater than the size (e.g., cross-sectional area) of at least one of the second apertures 44*b* and greater than the greatest size (e.g., cross-sectional area) of the head 56 extending from the respective base 54, where the planes in which the size (e.g., cross-sectional area) of (i) the respective second aperture 44*b*, (ii) the head 56, and (iii) the base 54 are each measured extend in the same (e.g., parallel) direction. For example, the size (e.g., area, peripheral dimension, etc.) of the upper or lower surfaces 59*a*, 59*b* may be greater than the size (e.g., area, peripheral dimension, etc.) of a respective one of the second apertures 44*b*.

Each lower support 20 may include any quantity, size, shape, and location of legs 58. In this regard, the quantity, size, shape, or location of the legs 58 may correspond to the quantity, size, shape, or location of the first apertures 44*a* defined by the first portion 16*a* of the lower packing component 16. For example, as illustrated in FIG. 4, in some implementations, each lower support includes two, four, or five legs 58 that define an L-shape in the plane defined by the base 54.

In some implementations, at least one of the lower supports 20 includes a primary leg 58-1. For example, as illustrated in FIGS. 1-4, the second and third lower supports 20-2, 20-3 each include a primary leg 58-1 extending from the base 54 in the second direction. The primary leg 58-1 may define a linear shape or construct extending along the base 54 of the lower supports 20-2, 20-3.

With reference to FIG. 4, a method of assembling the packaging system 10 may include placing, or otherwise locating, each of the lower supports 20 within one of the second apertures 44*b* such that the head 56 of the lower support 20 is disposed on a first side (e.g., the outer side) of the lower packing component 16, while the base 54 of the lower support 20 is disposed on a second side (e.g., the inner side) of the lower packing component 16. In some implementations, the base 54 of the lower support 20 engages the upper surface 38*b* of the second portion 16*b* of the lower packing component 16. For example, the upper surface 59*a* of the lower support 20 may engage the upper surface 38*b* of the lower packing component 16.

In some implementations, the first and fourth lower supports 20-1, 20-4 are each placed within one of the second apertures 44*b*, while the second and third lower supports 20-2, 20-3 are placed in the proximal and distal second apertures 44*b*-1, 44*b*-2, respectively. In this regard, the second and third lower supports 20-2, 20-3 may be placed in the proximal and distal second apertures 44*b*-1, 44*b*-2, respectively, such that the primary leg 58-1 of each of the second and third lower supports 20-2, 20-3 extends substantially parallel to (e.g., +/−10 degrees), or collinear with, the axis A1 or the edges 46, 48.

Figure 3:
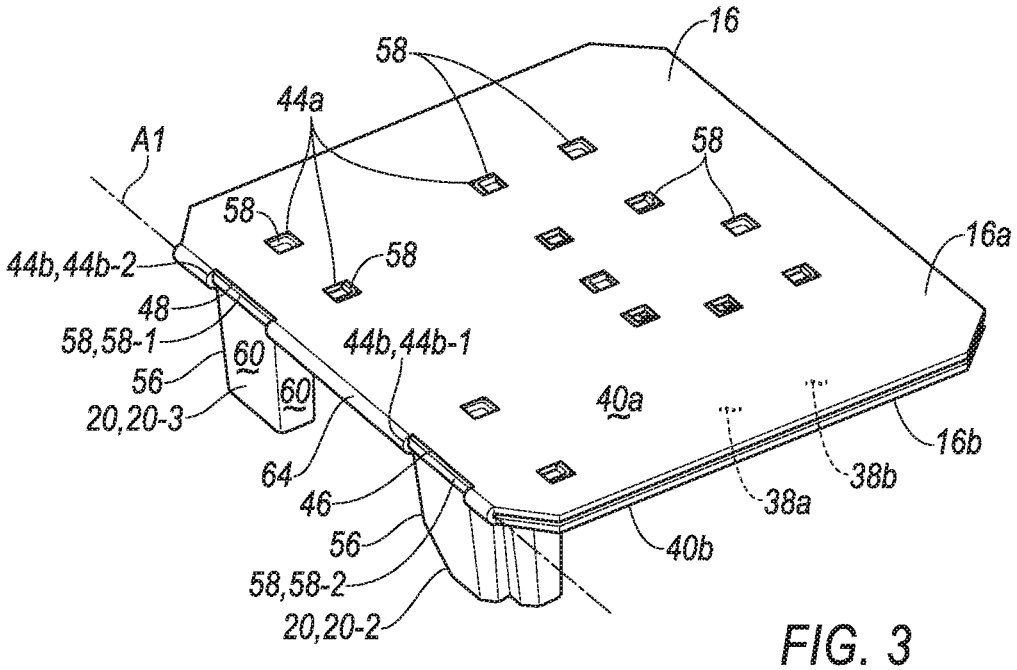
FIG. 3 is a bottom perspective view of a portion of the packaging system of FIG. 1, the portion shown in a first orientation.

With reference to FIGS. 2 and 3, the method of assembling the packaging system 10 may also include moving the first portion 16*a* of the lower packing component 16 relative to the second portion 16*b* of the lower packing component 16, or vice versa. For example, the method may include folding the lower packing component 16 along the axis A1 such that the upper surface 38*a* of the first portion 16*a* faces or engages the upper surface 38*b* of the second portion 16*b* or the base 54 of the lower supports 20, and such that the lower packing component defines a fold 64 extending along the axis A1. In this regard, moving, or otherwise folding the first portion 16*a* relative to the second portion 16*b* may include (i) disposing or locating the base 54 of each lower support 20 between, or into engagement with, the upper surfaces 38*a*, 38*b* of the first and second portions 16*a*, 16*b* of the lower packing component 16, (ii) locating or otherwise placing each leg 58 within one of the first apertures 44*a*, and (iii) engaging the primary legs 58-1, 58-2 of the second and third lower supports 20-2, 20-3 with the edges 46, 48, respectively, of the lower packing component 16. In particular, moving, or otherwise folding the first portion 16*a* relative to the second portion 16*b* may include placing the lower surface 59*b* of the base 54 of each lower support 20 into engagement with the upper surface 38*a* of the first portion 16*a* of the lower packing component 16.

With reference to FIG. 1, the method of assembling the packaging system 10 may also include placing the upper and lower supports 18, 20 into engagement with the component (e.g., transmission 12) to be packaged or shipped, and placing the lower surface 26 of the upper packing component 14 into engagement with the upper supports 18 such that the first and second lateral portions 14*b*, 14*c* face or engage the component to be packaged or shipped. The method may also include placing the component to be packaged or shipped, along with the upper and lower packing components 14, 16 and the upper and lower supports 18, 20 into a box or other container (not shown) prior to shipping. In some implementations, the method includes directly or indirectly coupling the lower packing component 16 to a box or other container 70 (FIG. 1). For example, adhesive (e.g., glue) may be placed on the lower surface 40*a* of the lower packing component 16, or on the box or other container 70, to adhere the lower surface 40*a* to the box or other container 70.

The configuration of the packaging system 10, including the configuration of the lower packing component 16 and the lower supports 20, allows a user to efficiently and effectively package and transport a component (e.g., transmission 12). For example, packaging system 10 may allow the user to package the component in a way that reduces the amount of material used in the packaging system, thereby reducing the cost, weight, manufacturing cycle time, and other characteristics of the packaging system 10, while increasing the effectiveness of the packaging system 10.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A packaging system comprising:

a support member having a base, a head portion, a first leg, and a primary leg, the head portion extending from the base in a first direction, the first leg extending from the base in a second direction opposite the first direction, and the primary leg extending from the base in the second direction; and a packing component having a first portion and a second portion, the first portion defining a first aperture configured to receive the first leg, the second portion defining a second aperture defined in part by an edge and configured to receive the head portion, wherein the primary leg engages the edge.

2. The packaging system of claim 1, wherein the packing component includes an upper surface engaging the base.

3. The packaging system of claim 1, wherein the packing component includes a first upper surface and a second upper surface, and the base includes an upper surface and a lower surface, and wherein the first upper surface is configured to engage the upper surface of the base, and the second upper surface is configured to engage the lower surface of the base.

4. The packaging system of claim 3, wherein the first upper surface is coplanar with the second upper surface.

5. The packaging system of claim 3, wherein the packing component defines an axis extending along the first upper surface and the second upper surface.

6. The packaging system of claim 5, wherein the packing component defines one or more perforations disposed along the axis.

7. The packaging system of claim 5, wherein the edge extends along the axis.

8. The packaging system of claim 1, wherein (i) the first leg is disposed within the first aperture, (ii) the head portion is disposed within the second aperture, (iii) the first portion of the packing component faces a first side of the base, and (iv) the second portion of the packing component faces a second side of the base, the second side being opposite the first side.

9. The packaging system of claim 8, wherein the packing component defines a fold extending between the first portion and the second portion.

10. A packaging system comprising:

a support member having a base, a head portion, a first leg, and a primary leg, the head portion extending from the base in a first direction, the first leg extending from the base in a second direction opposite the first direction, and the primary leg extending from the base in the second direction; and a packing component defining a first aperture and a second aperture, the second aperture defined in part by an edge, wherein the first leg is disposed within the first aperture, wherein the head portion is disposed within the second aperture, and wherein the primary leg engages the edge.

11. The packaging system of claim 10, wherein the base includes an upper surface and a lower surface, and wherein the packing component includes an upper surface engaging the upper surface of the base and the lower surface of the base.

* * * * *